US012342907B2

(12) United States Patent
Uzzeni

(10) Patent No.: US 12,342,907 B2
(45) Date of Patent: Jul. 1, 2025

(54) ELECTRICALLY DISSIPATIVE REMOVABLE INSOLE, PARTICULARLY FOR PROFESSIONAL WORK SHOES

(71) Applicant: U-POWER GROUP S.P.A., Paruzzaro (IT)

(72) Inventor: Pier Franco Uzzeni, Dagnente (IT)

(73) Assignee: U-POWER GROUP S.P.A., Paruzzaro (IT)

( * ) Notice: Subject to any disclaimer, the term of this patent is extended or adjusted under 35 U.S.C. 154(b) by 198 days.

(21) Appl. No.: 18/247,762

(22) PCT Filed: Oct. 6, 2021

(86) PCT No.: PCT/IB2021/059153

§ 371 (c)(1),
(2) Date: Apr. 4, 2023

(87) PCT Pub. No.: WO2022/074575

PCT Pub. Date: Apr. 14, 2022

(65) Prior Publication Data

US 2023/0413942 A1 Dec. 28, 2023

(30) Foreign Application Priority Data

Oct. 9, 2020 (IT) ..... 102020000023824

(51) Int. Cl.
*A43B 7/36* (2006.01)
*A43B 17/00* (2006.01)

(52) U.S. Cl.
CPC ..... *A43B 7/36* (2013.01); *A43B 17/006* (2013.01)

(58) Field of Classification Search
CPC ..... A43B 17/006; A43B 7/36
USPC ..... 361/223
See application file for complete search history.

(56) References Cited

U.S. PATENT DOCUMENTS 4,785,371 A * 11/1988 Edwards ..... A43B 17/006 361/224
5,319,867 A * 6/1994 Weber ..... A43B 17/003 36/43
2012/0192452 A1 8/2012 Lewis et al.

FOREIGN PATENT DOCUMENTS

CN 201515734 U * 6/2010
CN 208724984 U 4/2019
DE 203 15 805 U1 3/2004
DE 10 2004 014 231 B3 11/2005
JP 59-108404 A 7/1984
JP 59108404 U * 7/1984
(Continued)

OTHER PUBLICATIONS

Machine translation of Miura Japanese Patent Document JP S59-108404 U Jul. 1984 (Year: 1984).*
(Continued)

*Primary Examiner* — Kevin J Comber
(74) *Attorney, Agent, or Firm* — Oblon, McClelland, Maier & Neustadt, L.L.P.

(57) ABSTRACT

An electrically dissipative removable insole, including at least one lower layer made of an electrically dissipative material, and at least one upper layer overlapped on said lower layer made of a fabric of natural and/or synthetic fibers. The upper layer includes one or more openings which expose said electrically dissipative material of which said lower layer is made, and said one or more openings are adapted to allow direct contact of a sole of a wearer's foot with said electrically dissipative material.

13 Claims, 3 Drawing Sheets

(56) References Cited

FOREIGN PATENT DOCUMENTS

| | | | | |
|---|---|---|---|---|
| RU | 49688 U1 | 12/2005 | | |
| WO | WO-0004801 A1 * | 2/2000 | ..... | A43B 13/02 |

OTHER PUBLICATIONS

Machine translation of Wan Chinese Patent Document CN 201515734 U Jun. 2010 (Year: 2010).*
International Search Report issued Jan. 4, 2022 in PCT/IB2021/059153 filed on Oct. 6, 2021, 4 pages.
Office Action issued on Feb. 4, 2025, in corresponding RU Patent Application No. 2023108254.
Search Report issued on Feb. 3, 2025, in corresponding RU Patent Application No. 2023108254.

* cited by examiner

Fig. 1
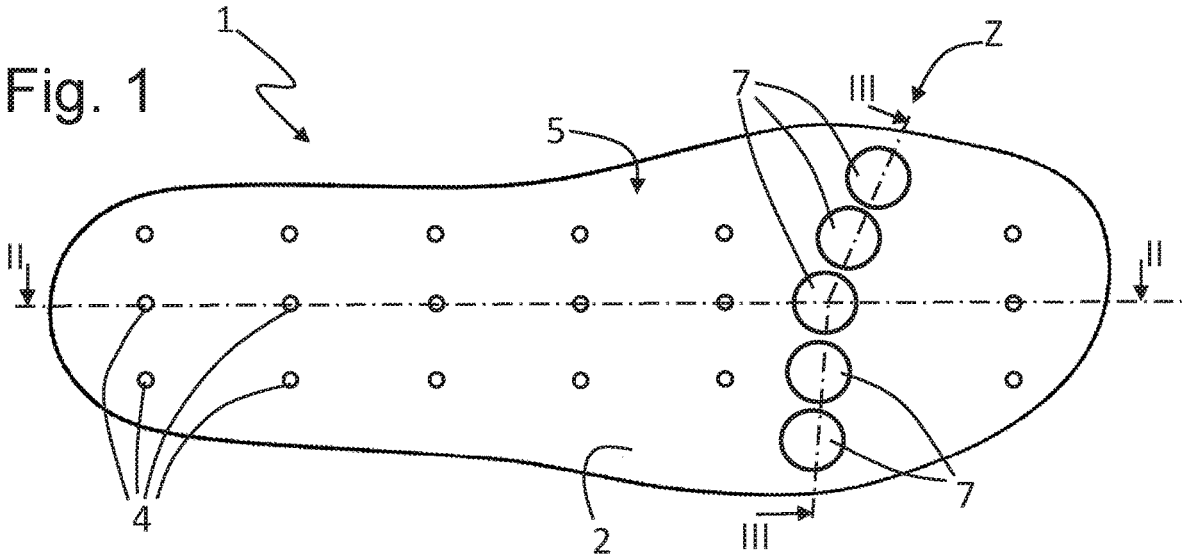
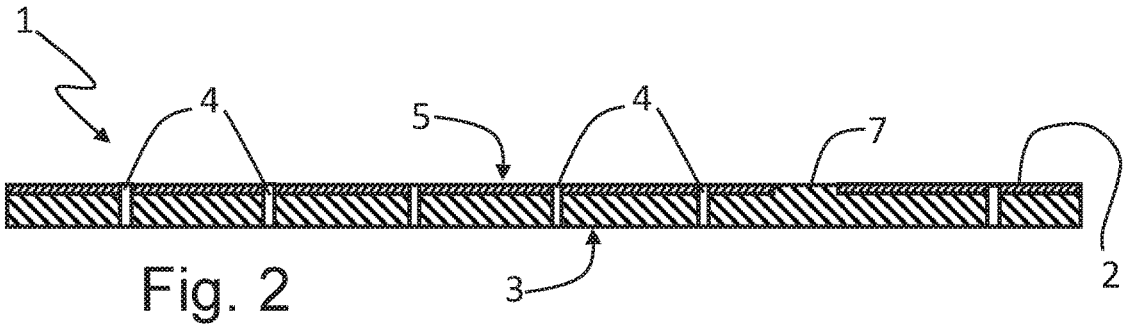
Fig. 2
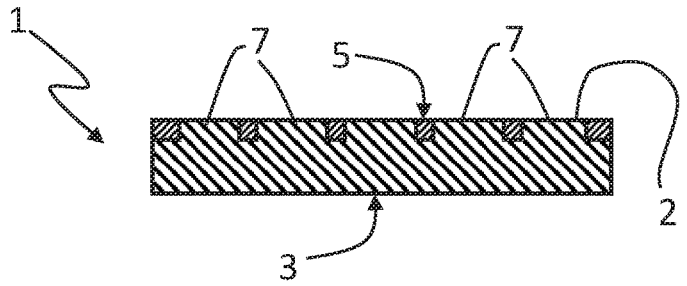
Fig. 3

ELECTRICALLY DISSIPATIVE REMOVABLE INSOLE, PARTICULARLY FOR PROFESSIONAL WORK SHOES

CROSS REFERENCE TO RELATED APPLICATIONS

This application is a National Stage entry under 35 U.S.C. § 371 of PCT/IB2021/059153, filed on Oct. 6, 2021, and claims priority to Italian Patent Application No. 102020000023824, filed on Oct. 9, 2020. The entire contents of both are incorporated herein by reference.

The present invention refers to an electrically dissipative removable insole, particularly for professional work shoes.

As is well known, operators working in environments with electronically controlled machinery, where microchips or transistors are assembled, in clean rooms, in chemical industries or, more generally, in environments where there is a risk of explosion or fire, are required to wear professional footwear capable of ensuring continuous and controlled dissipation, within safe values, of the electrostatic charges present on the body of the operator himself, in order to protect electronic devices sensitive to electrostatic phenomena and/or in order to prevent the accumulation of charges electrostatics whose sudden discharge might trigger explosions or fires.

Professional work shoes adapted to guarantee high electrostatic dissipation are often defined as "ESD" footwear, from the acronym "Electrostatic Discharge" and differ from antistatic footwear in a lower maximum electrical resistance to ground.

The standard CEI EN 61340-5-1 ("Electrostatics—Part 5-1: Protection of electronic devices from electrostatic phenomena—General requirements") prescribes for ESD footwear an overall electrical resistance to ground of the shoe/ground assembly, for footwear worn by the operator, less than $10^8\Omega$ (less than 100 megohms).

CEI EN 61340-4-3 ("Electrostatics—Part 4-3: Standard test methods for specific applications—Footwear") describes a test method for determining the electrical resistance of footwear, to be used to check the electrostatic potential present on the wearer. This method involves measuring the electrical resistance of footwear alone, as a whole, and serves as a qualification or acceptance test for new footwear, or even as a periodic test for footwear in use.

In particular, on the basis of the results of this test, a shoe may or may not be allowed to enter environments sensitive to electrostatic fields, such as for example the environments of the automotive industries.

As is well known, a professional shoe is mainly composed of a sole, or tread, of a midsole, possibly made by overlapping several different layers, and of the upper. If necessary, a safety toe cap can also be provided.

Every professional shoe also has a removable insole, or footbed, or insole, or even footbed cover, which is the part of the shoe in direct contact with the sole of the user's foot.

It is therefore clear that, in meeting the requirements of the above-mentioned rules for the protection against the dangers arising from electrostatic discharges, the dissipation and electrical conductivity characteristics of the removable insole are particularly critical, since the removable insole constitutes the main interface element between the wearer's body and the actual professional shoe, which in turn is in contact with the soil.

Currently, the removable insoles used in professional work shoes complying with the above-mentioned ESD footwear standards generally comprise a lower layer of polyurethane, or other similar electrically conductive material, surmounted by an upper layer consisting of a fabric made of natural and/or synthetic fibers which is adapted to provide the necessary qualities of hygiene and comfort when in contact with the user's foot.

Unlike the lower electrically conductive layer, the upper fabric layer of the known type of the removable insoles is not electrically conductive, and on the contrary represents an electrically insulating layer. Consequently, specific measures must be taken to ensure that the removable insole can allow the professional shoe as a whole to comply with the rules for the protection from the dangers deriving from electrostatic discharges mentioned above.

A first solution, illustrated schematically in FIG. 8, consists of sewing a seam in the upper fabric layer of the insole with a very thick conductive thread to ensure the electrical contact between the wearer's foot and the lower layer of polyurethane or other electrically conductive material. This very thick conductive thread covers almost the entire width of the insole and is generally located at the forefoot.

This well-known solution, however, has the disadvantage of worsening the comfort of the shoe, as the seam is made with a very thick conductive thread in relief, which is very uncomfortable for the user wearing the shoe. In addition, the application of such a seam increases the time and costs for producing the removable insole.

A second solution consists in making the upper fabric layer of the removable insole by using a plurality of electrically conductive threads in the weft of the same, which thus define a sort of conductive network within the weft itself of the fabric. This solution is better than the previous one in terms of comfort for the wearer, but involves very high production costs, due both to the cost of the electrically conductive threads and the cost of the complex operations for producing the fabric itself.

The main task of the present invention consists in making an electrically dissipative removable insole that overcomes the limitations of the prior art outlined above.

In the context of this task, an object of the present invention consists in making an electrically dissipative removable insole that is easy to make and economically competitive when compared to the prior art.

Another object of the invention consists in making an electrically dissipative removable insole that is optimal in terms of user comfort.

A further object of the invention consists in making an electrically dissipative removable insole which is capable of giving the greatest assurances of reliability and safety in use.

The above-mentioned task, as well as the aforementioned objects and others that will better appear later, are achieved by an electrically dissipative removable insole, particularly for professional work shoes, as recited in claim 1.

Other features are comprised in the dependent claims.

Further characteristics and advantages will become clearer from the description of four preferred, but not exclusive, embodiments of an electrically dissipative removable insole, particularly for professional work shoes, illustrated for indicative and non-limiting purposes with the aid of the attached drawings in which:

FIG. 1 is a top plan view of a first embodiment of an electrically dissipative removable insole, according to the invention;

FIG. 2 is a sectional view of the removable insole shown in FIG. 1 taken along the axis II-II;

FIG. 3 is a sectional view of the removable insole shown in FIG. 1 taken along the axis III-III;

Figure 4:
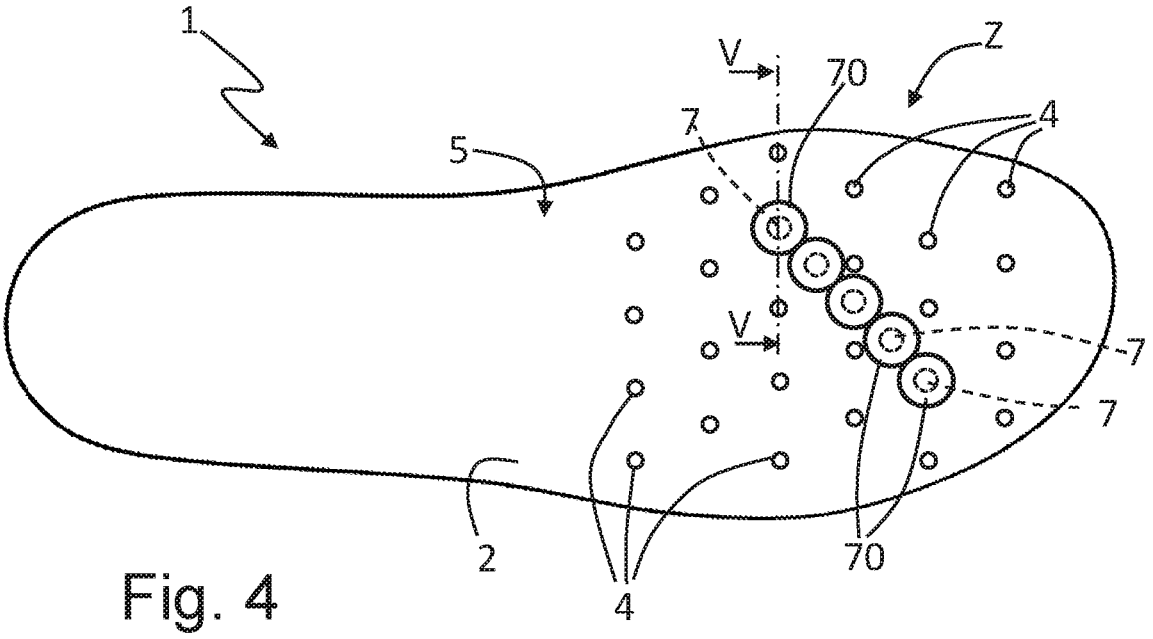
FIG. 4 is a top plan view of a second embodiment of an electrically dissipative removable insole, according to the invention.

With reference to the above-mentioned figures, the electrically dissipative removable insole, indicated globally by reference numeral 1, comprises at least one lower layer 3 made of an electrically dissipative material and at least one upper layer 5 overlapped on said lower layer 3, made of a fabric of natural and/or synthetic fibers.

The electrically dissipative material in which the lower layer 5 is made has values of electrical resistance to ground that are compatible with the standards CEI EN 61340-5-1 and CEI EN 61340-4-3 mentioned in the introductory part, and in particular with the standards CEI EN 61340-5-1:2016 and CEI EN 61340-4-3:2017. Advantageously, therefore, the electrically dissipative material in which the lower layer 5 is made has values of electrical resistance to ground of less than $10^8\Omega$ (100 megohms).

According to the invention, the upper layer 5 comprises one or more openings 7, 8, 9, 10 which expose the electrically dissipative material in which the lower layer 3 is made. In the use of the removable insole 1 in a professional work shoe, such one or more openings 7, 8, 9, 10 are adapted to allow direct contact of the sole of the wearer's foot with the electrically dissipative material in which the lower layer 3 is made.

In this way, through one or more openings 7, 8, 9, the wearer's foot is always in direct contact with the electrically dissipative material in which the lower layer 3 is made. Consequently, the values of electrical resistance to ground of the professional work shoe as a whole are not affected by the presence of the upper layer in electrically insulating fabric, necessary to guarantee the required comfort and hygiene of the insole 1 itself.

Advantageously, the electrically dissipative material in which the lower layer 3 is made may comprise polyurethane, for example polyurethane foam, or it may consist exclusively of polyurethane, for example polyurethane foam. Such a material may comprise, for example, visco-elastic polyurethane foam.

Other types of materials suitable for making the lower layer 3 may be ethylene vinyl acetate (EVA), thermoplastic polyurethane (TPU) or rubber.

Preferably, the development of the electrically dissipative material in which the lower layer 3 is made involves using chemical agents adapted to ensure that the material has a low electrical resistance.

Advantageously, the total area of the electrically conductive material in which the lower layer 3 is made and which is exposed through said one or more openings 7, 8, 9, 10 is greater than or equal to 1% of the total surface area of the removable insole 1, preferably greater than or equal to 2%, and even more preferably greater than or equal to 3%.

Advantageously, as illustrated in particular in FIGS. 2 and 3, the electrically dissipative material in which the lower layer 3 is made emerges through said one or more openings 7, 8, 9, 10 at least up to the upper surface 2 of the removable insole 1.

In this way, irrespective of the thickness values of the upper fabric layer 5, the wearer's foot resting on the upper surface 2 of the removable insole 1 is always in contact with the electrically dissipative material in which the lower layer 3 of the removable insole 1 is made.

In essence, it is preferable that the electrically dissipative material fills the openings 7, 8, 9, 10, bridging the thickness of the upper fabric layer 5.

Advantageously, said one or more openings 7, 8, 10 are arranged in correspondence with the zone Z of the removable insole 1 adapted, in use, to come into contact with the transverse plantar arch of the user's foot, and preferably in correspondence with the metatarsals, and in particular with the metatarsal heads.

In fact, the metatarsal heads, together with the heel, represent the structures of the foot on which most of the body load is distributed, both under static conditions and movement conditions.

Therefore, both under static conditions and movement conditions, the foot of the user is practically always in contact with the electrically dissipative material in which the lower layer 3 of the insole 1 is made, through the openings 7, 8, 10 located precisely in this zone Z of the insole 1.

Advantageously said one or more openings 7, 8, 9, are arranged so as to affect at least 50% of the transversal width of the removable insole 1, and preferably at least 60% thereof.

As illustrated in the accompanying figures, the openings 7, 8, 10 are preferably arranged in the zone Z of the insole 1 in correspondence with the transverse plantar arch and preferably affect substantially the entire transversal width of the removable insole 1 in correspondence with said zone Z.

In this way, the contact of the user's foot with the electrically dissipative material in which the lower layer 3 of the insole 1 is made is guaranteed both in the case of physiological rest of the sole of the foot on the ground, and in the case of "flat foot" or of "hollow foot".

Figure 5:
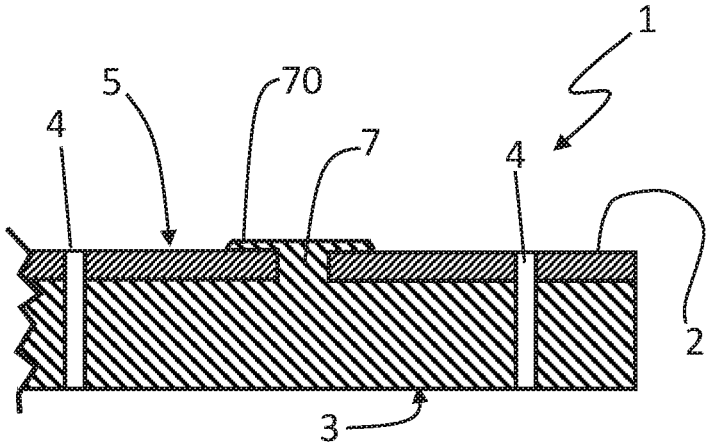
FIG. 5 is a sectional view of the removable insole represented in FIG. 4 taken along the axis V-V.

Advantageously, as illustrated in FIG. 5, one or more openings 9 may be made in the upper fabric layer 5 in correspondence with the zone of the removable insole 1 on which the wearer rests the heel.

Preferably the one or more openings 9 made in the heel rest zone are associated with one or more openings 7, 8, 10 made in the rest zone Z of the metatarsal heads of the wearer's foot.

Advantageously, as illustrated in FIG. 1 and FIG. 4, the openings 7, 8, 9, 10 can consist of a plurality of substantially circular holes 7.

Advantageously, two or more substantially circular holes 7 may be provided side by side so as to be arranged along the width of the removable insole 1, preferably at least four holes are provided.

For example, as illustrated in FIG. 1, five different, substantially circular holes 7 may be provided in correspondence with the five metatarsal heads of the wearer's foot.

Figure 7:
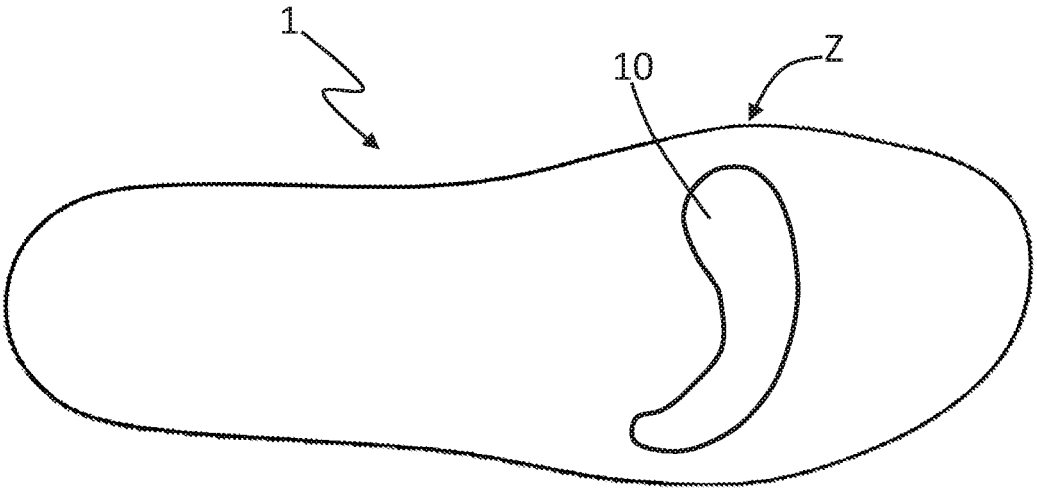
FIG. 7 is a top plan view of a fourth embodiment of an electrically dissipative removable insole, according to the invention.
Figure 8:
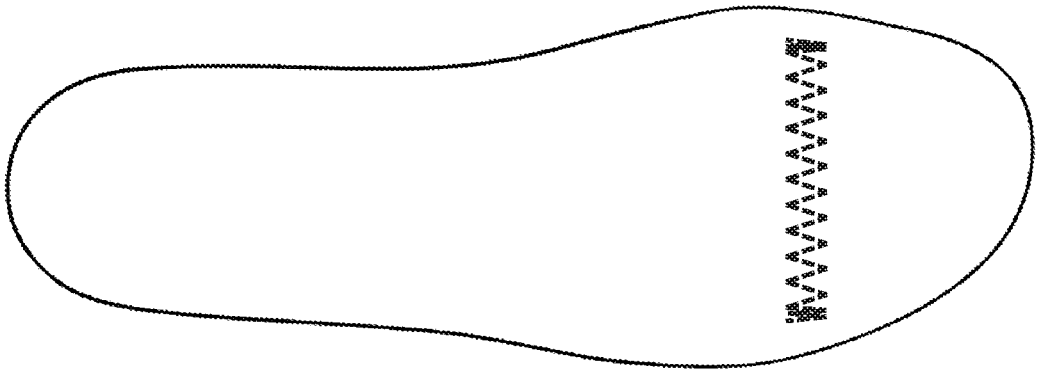
Fig. 8 (PRIOR ART)
FIG. 8 is a top plan view of an electrically dissipative removable insole, realized according to the teachings of the known art.

Instead, as illustrated for example in FIG. 7, a single opening 10 may be provided.

Such a single opening 10 is preferably arranged in correspondence with the zone Z described above and has a substantially elongated shape in the transverse direction, so as to affect substantially the entire width of the removable insole 1.

Said single opening 10 may have a comma shape wherein the widest portion is arranged substantially in correspondence with the first metatarsal head of the user's foot.

Figure 6:
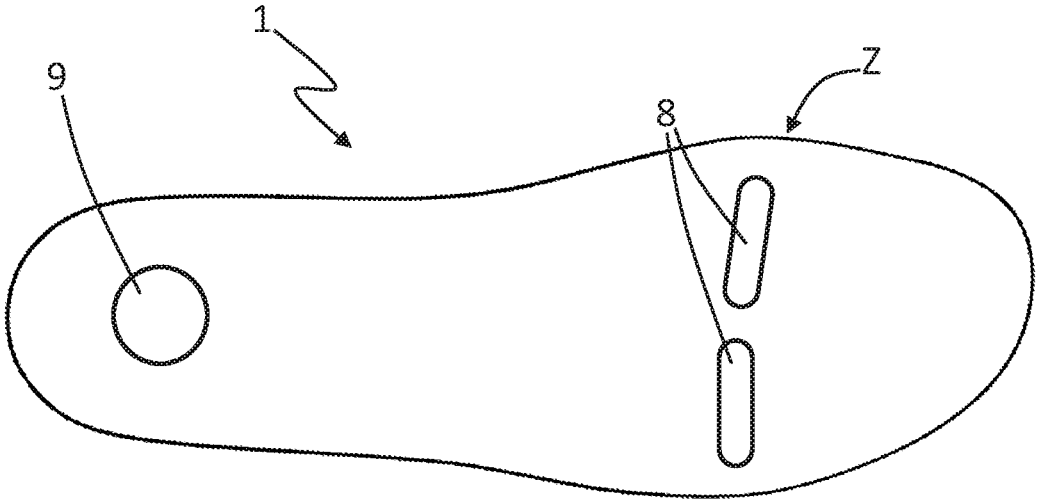
FIG. 6 is a top plan view of a third embodiment of an electrically dissipative removable insole, according to the invention.

In the embodiment illustrated in FIG. 6, the removable insole 1 has a pair of openings 8, preferably oblong in shape, arranged in correspondence with the zone Z described above and a further opening 9, preferably substantially circular in shape, in correspondence with the heel zone.

Advantageously, provided that the total area of the electrically dissipative material which is exposed through said one or more openings 7, 8, 9, 10 is greater than or equal to 1% of the total surface area of the removable insole 1, each of said one or more openings 7, 8, 9, 10 has an area greater than or equal to 7 $mm^2$, corresponding, in case of circular opening 7, to a hole having with a diameter greater than or equal to 3 mm.

Preferably, each of said one or more openings 7, 8, 9, 10 has an area greater than or equal to 18 $mm^2$, corresponding, in case of circular opening 7, to a hole with a diameter greater than or equal to 4.8 mm.

In this way, it is possible to ensure that, for example in case of a removable insole 1 comprising many but small openings 7, 8, 9, 10, each single opening 7, 8, 9, 10 is large enough to ensure a proper contact of the foot with the electrically dissipative material in which the lower layer 3 of the removable insole 1 is made.

In particular, as explained below, an opening 7, 8, 9, 10 having an area greater than or equal to 7 $mm^2$ allows the electrically dissipative material with which the lower layer 3 is obtained to cross, during the construction of the removable insole 1, the opening 7, 8, 9, 10 itself to reach the upper surface 2 of the removable insole 1.

Advantageously, the total area of the electrically conductive material in which the lower layer 3 is made and which is exposed through said one or more openings 7, 8, 9, 10 is smaller than or equal to 15% of the total surface area of the removable insole 1, is preferably less than or equal to 10%, and more preferably less than or equal to 5%.

In essence therefore, the total area of the electrically conductive material in which the lower layer 3 is made and which is exposed through said one or more openings 7, 8, 9, 10 is preferably comprised between 1% (or 2%, or 3%) and 15% (or 10%, or 5%) of the total surface area of the removable insole 1.

In fact, the total dimensions of the total area of the electrically conductive material exposed through the openings 7, 8, 9, 10 appear to be a compromise between the need to have a sufficiently large area to ensure that, due to the presence of the upper fabric layer 5, no conditions of electrical insulation occur between the lower layer 3 in electrically dissipative material and the user's foot and the need to limit the direct contact area of the user's foot with the electrically dissipative material in which the lower layer 3 is made for the reasons of comfort and hygiene described above. In fact, it is specifically the upper layer 5 made of fabric in natural and/or synthetic fibers that allows the foot to breathe and stay dry. In addition, the antimicrobial and antibacterial properties of the removable insole 1 are also specifically conferred by the fabric in which the upper layer 5 of the insole 1 itself is made.

Advantageously, as illustrated in FIGS. 4 and 5, the electrically conductive material in which the lower layer 3 is made may emerge through the openings 7, 8, 9, and also protrudes laterally with respect to the perimeter edges of the opening 7, 8, 9, 10 itself. FIGS. 4 and 5 indicate with 70 the part of electrically conductive material which protrudes perimetrically with respect to the opening 7.

In this case, the surface area of electrically conductive material which comes into contact with the foot of the user through the opening 7, 8, 9, 10 is greater than the area of the opening 7, 8, 9, 10 itself.

Advantageously, the surface area of the electrically conductive material that emerges on the upper surface 2 of the insole 1 through a corresponding opening 7, 8, 9, 10, protruding laterally to the edges thereof, is greater than or equal to 110% of the area of the opening 7, 8, 9, 10 itself.

In other words, the total surface area of the electrically conductive material which comes into contact with the user's foot through the opening 7, 8, 9, 10 is greater than or equal to 110% of the area of the opening 7, 8, 9, 10 itself.

Advantageously, in case of the openings 7, 8, 9, 10 having an area less than or equal to 30 $mm^2$ (corresponding, in case of circular opening 7, to a hole with diameter of less than or equal to 6 mm), the surface area of the electrically conductive material that emerges on the upper surface 2 of the insole 1 through such an opening 7, 8, 9, 10, protruding laterally to the edges thereof, is greater than or equal to 150% of the area of the opening 7, 8, 9, 10 itself. In other words, the total surface area of the electrically conductive material which comes into contact with the user's foot through the opening 7, 8, 9, 10 is greater than or equal to 150% of the area of the opening 7, 8, 9, 10 itself.

Preferably, in case of the openings 7, 8, 9, 10 having an area less than or equal to 18 $mm^2$ (corresponding, in case of a circular opening 7, to a hole with diameter of less than or equal to 4.8 mm), the surface area of the electrically conductive material that emerges on the upper surface 2 of the insole 1 through such an opening 7, 8, 9, 10, protruding laterally to the edges thereof, is greater than or equal to double the area of the opening 7, 8, 9, 10 itself, preferably greater than or equal to triple the area of the opening 7, 8, 9, 10 itself. In other words, the total surface area of the electrically conductive material which comes into contact with the user's foot through the opening 7, 8, 9, 10 is greater than or equal to triple the area of the opening 7, 8, 9, 10 itself.

In this way, it is possible to ensure that the user's foot establishes an efficient electrically dissipative contact with the material of the lower layer 3 of the removable insole 1 while providing through openings 7, 8, 9, 10 through the upper layer 5 with reduced dimensions.

Advantageously, the electrically dissipative removable insole 1 comprises a plurality of transpiration through holes 4 that necessarily cross at least the lower layer 3 of the removable insole 1.

Advantageously, the transpiration through holes 4 cross both the lower layer 3 and the upper layer 5 of the removable insole 1.

Such transpiration through holes 4 have diameters advantageously comprised between 2.5 mm and 5 mm, and preferably equal to about 4 mm.

The transpiration through holes 4 can be obtained both in correspondence with zones of the insole 1 where both the lower layer 3 and the upper layer 5 are present, and in correspondence with the aforesaid openings 7, 8, 9, 10, i.e., in zones of the insole 1 where the upper layer 5 is absent.

As illustrated in FIG. 4, the transpiration holes 4 may be obtained in correspondence with the front zone of the removable insole 1, which often has lower total thicknesses than the rear zone in correspondence with the heel of the user.

The process for making the electrically dissipative removable insole 1 takes place in a mould where the upper layer 5, provided with the openings 7, 8, 9, 10, is previously housed. The viscous material in liquid form, which will form the lower layer 3, is injected or poured into the mould so that it adheres to the upper layer 5. Advantageously, the mould comprises a series of dams which convey the material in liquid form, at the desired density, temperature and pressure, to the exact points where it is to emerge, through the openings 7, 8, 9, 10. In this way it is possible to ensure that the electrically conductive material in which the lower layer 3 is made reaches the upper surface 2 of the upper layer 5 when the insole 1 is finished, possibly also expanding beyond the lateral edges of the openings 7, 8, 9, 10 themselves, as illustrated in FIGS. 4 and 5.

The functioning of the electrically dissipative removable insole, particularly for professional work shoes, is clear and obvious from what has been described.

During use of the professional shoe, the user's foot is always in contact with the electrically dissipative polyurethane of the insole, and therefore the values of electrical resistance to ground of the footwear as a whole required by the current standards are always safeguarded.

In practice, it has been found that the electrically dissipative removable insole, particularly for professional work shoes, fulfils the task and the intended purposes, as it enables the compliance with the standards in force with reference to the protection from the dangers deriving from electrostatic discharges.

Another advantage of the electrically dissipative removable insole, according to the invention, consists in that it is easy and inexpensive to make, as it requires neither the application of seams with electrically conductive threads nor the use of electrically conductive threads in the weft of the fabric which constitutes the upper layer of the insole itself.

A further advantage of the electrically dissipative removable insole, according to the invention, consists in that it is possible to choose any type of fabric for making the upper layer of the removable insole, without any technical or aesthetic limitations. For example, yarns of any type freely selectable on the basis of the technical and aesthetic characteristics that the fabric layer of the insole should have can be used.

Another advantage of the electrically dissipative removable insole, according to the invention, is that it is anatomical.

The electrically dissipative removable insole as it is conceived is susceptible to numerous modifications and variants, all falling within the scope of the inventive concept.

Furthermore, all the details can be replaced by other technically equivalent elements.

In practice, any materials can be used according to requirements, as long as they are compatible with the specific use, the dimensions and the contingent shapes.

The invention claimed is:

1. An electrically dissipative removable insole, comprising:

at least one lower layer made of an electrically dissipative material; and at least one upper layer overlapped on said lower layer made of a fabric of natural and/or synthetic fibers, wherein said upper layer comprises one or more openings which expose said electrically dissipative material of which said lower layer is made, wherein said one or more openings are adapted to allow direct contact of a sole of a wearer's foot with said electrically dissipative material, and wherein said electrically dissipative material emerges through said one or more openings on an upper surface of said removable insole and protrudes laterally with respect to perimeter edges of said one or more openings.

2. The electrically dissipative removable insole according to claim 1, wherein a total area of said electrically dissipative material which is exposed through said one or more openings is greater than or equal to 1% of a total surface area of said removable insole.

3. The electrically dissipative removable insole according to claim 1, wherein said one or more openings are arranged in correspondence with a zone (Z) of said removable insole configured to come into contact with a transverse plantar arch of the wearer's foot.

4. The electrically dissipative removable insole according to claim 1, wherein said one or more openings are arranged in such a way as to occupy at least 50% of a transversal width of said removable insole.

5. The electrically dissipative removable insole according to claim 1, wherein said one or more openings consist of a plurality of substantially circular holes.

6. The electrically dissipative removable insole according to claim 1, wherein said one or more openings consist of a single opening.

7. The electrically dissipative removable insole according to claim 1, wherein each of said one or more openings has an area greater than or equal to 7 $mm^2$.

8. The electrically dissipative removable insole according to claim 1, wherein a total area of said electrically dissipative material which is exposed through said one or more openings is smaller or equal to 15% of a total surface area of said removable insole.

9. The electrically dissipative removable insole according to claim 1, further comprising a plurality of transpiration through holes which cross at least said lower layer of said removable insole.

10. The electrically dissipative removable insole according to claim 1, wherein a surface area of said electrically dissipative material coming into contact with the wearer's foot through said one or more openings is greater than an area of the one or more openings themselves.

11. The electrically dissipative removable insole, according to claim 1, wherein a surface area of said electrically dissipative material that emerges on said upper surface of said removable insole through said one or more openings and protrudes laterally is greater than or equal to 110% of an area of said one or more openings themselves.

12. The electrically dissipative removable insole, according to claim 1, wherein said one or more openings each have an area less than or equal to 30 $mm^2$, and wherein a surface area of said electrically dissipative material that emerges on said upper surface of said removable insole through said one or more openings and protrudes laterally is greater than or equal to 150% of an area of the one or more openings themselves.

13. The electrically dissipative removable insole, according to claim 1, wherein said one or more openings have an area less than or equal to 18 $mm^2$, and wherein a surface area of said electrically dissipative material that emerges on said upper surface of said removable insole through said one or more openings and protrudes laterally is greater than or equal to double, an area of the one or more openings themselves.

* * * * *